US008371481B2

(12) United States Patent
Kopp

(10) Patent No.: US 8,371,481 B2
(45) Date of Patent: Feb. 12, 2013

(54) VALVE FOR A CONTAINER FOR DISPENSING PRESSURIZED FLUID

(75) Inventor: Volker Kopp, Esslingen (CH)

(73) Assignee: C. Ehrensperger AG, Staefa (CH)

( * ) Notice: Subject to any disclaimer, the term of this patent is extended or adjusted under 35 U.S.C. 154(b) by 626 days.

(21) Appl. No.: 12/589,061

(22) Filed: Oct. 16, 2009

(65) Prior Publication Data

US 2010/0147897 A1 Jun. 17, 2010

(30) Foreign Application Priority Data

Oct. 16, 2008 (DE) ..... 10 2008 051 888

(51) Int. Cl.
*B65D 83/00* (2006.01)

(52) U.S. Cl. ..... 222/402.1; 222/402.24; 222/542; 251/149.6; 251/354; 251/356

(58) Field of Classification Search ..... 222/402.1, 222/402.21–402.25, 542, 518; 251/149.6, 251/349, 353–354, 339, 356
See application file for complete search history.

(56) References Cited

U.S. PATENT DOCUMENTS 2,829,806 A * 4/1958 Tedaldi ..... 222/402.22
3,773,064 A * 11/1973 Focht ..... 137/244
5,014,887 A * 5/1991 Kopp ..... 222/402.1
5,762,319 A * 6/1998 Kopp ..... 251/149.6
6,058,960 A * 5/2000 Kopp ..... 137/68.11
6,371,338 B1 * 4/2002 Klein et al. ..... 222/402.1
6,817,494 B2 * 11/2004 Lilienthal ..... 222/402.24
7,261,225 B2 * 8/2007 Rueschhoff et al. ..... 222/402.25
8,074,848 B2 * 12/2011 Pittl et al. ..... 222/402.24
2005/0121476 A1 * 6/2005 Pauls et al. ..... 222/402.24

FOREIGN PATENT DOCUMENTS

EP 0 350 779 B1 12/1992

* cited by examiner

*Primary Examiner* — Frederick C. Nicolas

(74) *Attorney, Agent, or Firm* — Kriegsman & Kriegsman

(57) ABSTRACT

The invention relates to a valve for a container for dispensing pressurized fluid, the valve having a valve body which is mountable on a container lid, a closure member which is arranged in a passage provided in the valve body, a sealing arranged on the closure member and formed of at least one disc-shaped sealing lip and which, when the closure member is in a closing position relative to the valve body, abuts on a valve seat provided on the passage, and a holding device by which the closure member is displaceably arranged in the valve body and held in a closing position therein when it is in its normal position, at least one wear protection device being associated with the at least one sealing lip upstream with respect to the outflow direction of the fluid.

15 Claims, 2 Drawing Sheets

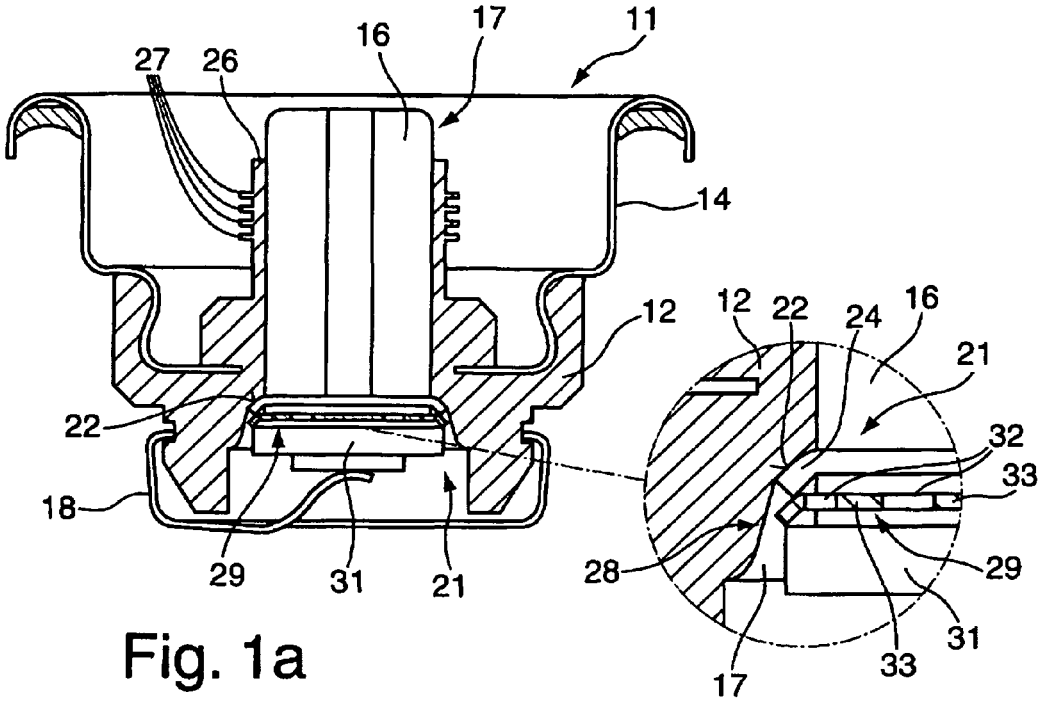
Fig. 1a
Fig. 1b
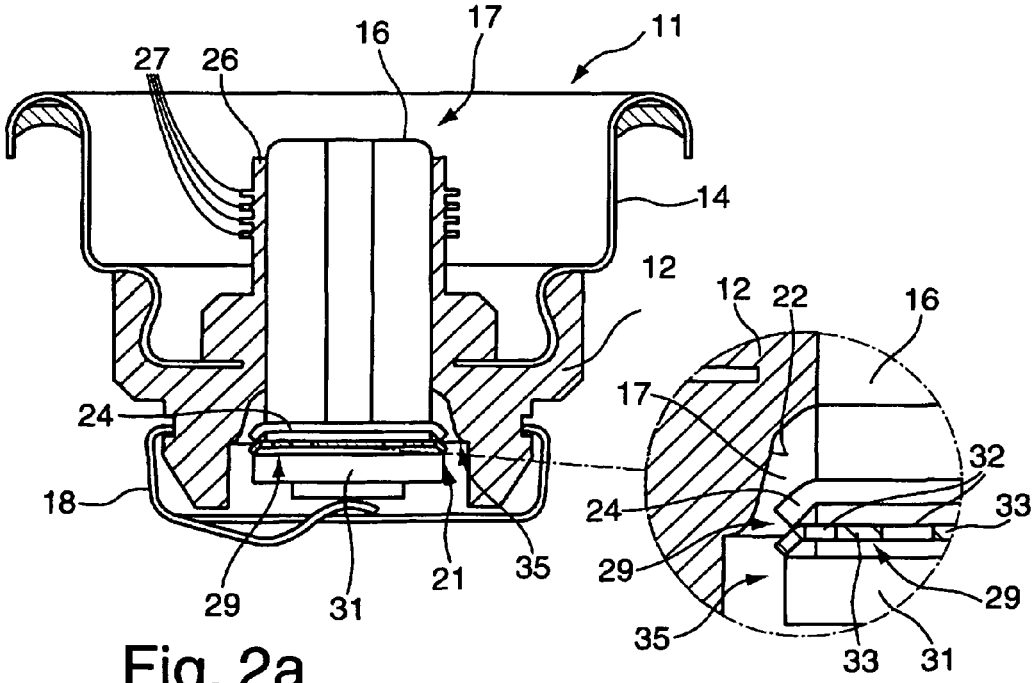
Fig. 2a
Fig. 2b

VALVE FOR A CONTAINER FOR DISPENSING PRESSURIZED FLUID

CROSS-REFERENCE TO RELATED APPLICATIONS

The present application claims the benefit under 35 U.S.C. 119 of the following foreign priority application, the disclosure of which is hereby incorporated by reference: German Patent Application No. 10 2008 051 888.3, filed Oct. 16, 2008.

BACKGROUND OF THE INVENTION

The invention relates to a valve for a container for dispensing pressurized fluid according to the preamble of claim 1.

A valve of this type is known from EP 0 350 779 B1. This valve comprises a valve body which may be mounted on a container lid. The container lid is fastened on a container, usually on a can. The valve body accommodates a closure member which is arranged in a passage of the valve body. The closure member is provided with a sealing which consists of at least one sealing lip. When the closure member is in a closing position, the sealing abuts on a valve seat provided in the passage of the valve body and closes the passage. By means of holding means which abut on the valve body, the closure member is displaceably arranged within the valve body and is held in a closing position when it is in its non-actuated position.

Valves of this type are used, for example, in aerosol cans containing a medium that cures after its application. The fluids conserved and discharged usually include polyurethane foams and adhesives. These polyurethane foams are humidity-sensitive and cure even under normal atmospheric conditions, due to the moisture present in the air. On discharging such a fluid, in particular in cases in which a can is not completely emptied in one work cycle, an opening and closing movement of the valve body is performed. Due to said curing property of the fluid, a curing of the fluid will occur, for example, in a region between a sealing lip and a punch portion of the valve body, producing a hard and at least partially annular remainder of cured fluid. In the course of a subsequent opening and closing of the valve for a further discharging of fluid, the at least partially annular remainder of cured fluid which has been formed may become detached, either entirely or in part, and get between the valve seat and the sealing, or near the at least one sealing lip, as the valve is subsequently closed. This may cause damage to the valve seat and/or the sealing lip, such that a complete closing may no longer be ensured. Thus, either pressurised fluid may continue to escape or air may enter into the interior of the container due to the non tightly sealing valve and cause a curing of the fluid inside the container.

SUMMARY OF THE INVENTION

It is therefore an object of the invention, to provide a valve for a container for dispensing pressurized fluid which allows a reliable opening and closing for repeated use, in particular when the appliance is not in use for an extended period of time.

This object is achieved according to the invention by the features of claim 1. Other advantageous configurations and developments are mentioned in the further claims.

Due to the configuration of the valve according to the invention with a wear protection device which is arranged upstream of the at least one sealing lip with respect to the flow direction, it is made possible that at least one remainder of cured fluid of at least partially annular shape, or of any other shape, which may have formed may be safely carried along during the opening and closing movements of the closure member for a subsequent discharging of the fluid, in such a manner that the cured fluid will not become detached from the closure member. Thus it is ensured that even after repeated use, both the valve seat and the sealing lip will abut on each other across their entire contact surface so as to ensure a completely tight condition of the valve. Due to the fact that the at least one remainder of cured fluid is safely accommodated in, and carried along with, the closure member, the at least one remainder of cured fluid, or parts of the at least one remainder of cured fluid, is/are prevented from becoming detached from the closure member and hence from impeding the opening and closing movements or from damaging the sealing surfaces on the valve seat and/or the sealing lip.

According to a preferred configuration of the invention, the wear protection device is designed to be realised in the form of at least one retaining lip. Thus a simple configuration and an inexpensive fabrication of a wear protection device are made possible.

According to a further preferred configuration of the invention, the retaining lip is designed to be provided with anchoring elements which are preferably realised by recesses formed in the retaining lip, which is in particular disc-shaped. Due to these recesses, or rather due to the anchoring elements limiting said recesses and preferably extending radially outward, it is made possible that fluid in the process of curing becomes anchored to, or at least partially surrounds, the anchoring elements, whereby an at least positive engagement between the fluid in the process of curing and the anchoring elements is formed. Owing to said at least positive engagement, the cured fluid may participate in the opening and closing movements and the passage for releasing the fluid will not be impeded by at least parts of the cured fluid.

According to a further preferred configuration of the invention, the retaining lip is designed to be arranged at a distance so as to form a gap between it and the at least one sealing lip. The configuration of the retaining member, which is in particular disc-shaped, enables a simple and constructive design. At the same time, providing said gap makes it possible that cured fluid is formed in this gap and a safe anchorage is also enabled by its disposition in the gap.

The anchoring elements, or rather the recesses formed therebetween, are preferably arranged about the circumference of the retaining lip, in such a manner as to be equally spaced apart from one another. Thus, simple geometrical configurations are obtained which permit the cured fluid to be safely accommodated.

According to an alternative configuration of the invention, the recesses are designed to be U-shaped or rectangular, with all U-shaped or rectangular recesses being, in particular, equally aligned with respect to their parallel sides. Thus, an undercut may be formed which, in turn, extends to the neighbouring zone, respectively, as considered in the circumferential direction, in order to enable a positive engagement and a safe accommodation of the cured fluid.

According to a particularly well-conceived constructive configuration, the retaining lip is designed to have an outer circumference which is preferably equal to, or smaller than, the at least one sealing lip. Thus it is made possible that the retaining lip does not abut on the valve seat and that the sealing lip may be in contact with, and be deformed by, the valve seat without being influenced by the retaining lip.

According to a further preferred configuration of the invention, a punch portion of the closure member, which is arranged adjacent to the retaining lip and opposite the sealing lip with respect to the retaining lip, is designed to have an outer periphery which is equal to, or smaller than, the outer periphery of the retaining lip. Thus, it is possible to achieve the advantage that during an opening movement cured fluid, which has formed to a small extent at least partially round the punch portion, may safely be carried back in the direction of the interior of the container by the retaining lip which extends beyond said cured fluid about the circumference.

The thickness of the disc-shaped retaining lip is preferably formed so as to be equal to, or smaller than, the thickness of the sealing lip. Thus it is possible that the retaining lip, owing to the deformation of the sealing lip by the closing position in the valve seat, may participate, at least to a small degree, in this deformation, while not exerting any negative influence on the closing position of the sealing lip in the valve seat.

According to another advantageous configuration of the invention, the gap between the sealing lip and the retaining lip and/or the width of the disc-shaped sealing lip with respect to the disc-shaped retaining lip and/or the thickness of the sealing lip as compared to the retaining lip are designed such that the sealing lip may be deformed in the valve seat and an outer, leading edge facing the retaining lip abuts on said retaining lip or may be arranged at a close distance thereof. This configuration has the advantage that in the gap formed between the sealing lip and the retaining lip an undercut is realised in order to safely accommodate the cured fluid.

An analogous assembly is preferably provided for the retaining lip in relation to the punch portion on the closure member. Thus, it is advantageously achieved that a gap between the punch portion and the retaining lip equally acts as an undercut for safely accommodating the at least one remainder of cured fluid. In addition, because of the recesses existing between the anchoring elements, the cured fluid formed between the retaining lip and the sealing lip and the one formed between the punch portion and the retaining lip are allowed to form land-shaped connecting portions between each other, such that the entire zone which adjoins the sealing lip and which is subject to the risk of a formation of at least one remainder of cured fluid, is interconnected by lands and is fixed with respect to the valve body at least by positive engagement due to undercuts.

According to a further preferred configuration of the invention, the retaining lip is designed to be arranged at a distance from the valve seat and preferably with a gap separating it from a lateral area of the passage surrounding the closure member when the closure member is in a closing position. Thus, it is possible that on an opening movement the cured fluid which may have formed on the retaining lip is immediately lifted off from the passage. Thus, the remainders of cured fluid are prevented from breaking and causing damage to the valve.

According to a further preferred configuration of the invention, the at least one retaining lip is integrally formed with the closure member. Thus they may be fabricated in a simple manner as an injection-moulded part.

Alternatively, the at least one retaining lip may be designed to be formed as a slip-on ring. Thus, it is possible to achieve greater flexibility as far as the configuration of the ring is concerned.

BRIEF DESCRIPTION OF THE DRAWINGS

The invention, as well as other advantageous embodiments and developments thereof, will be described and explained in the following with reference being made to the examples shown in the drawings. The characteristics issuing from the description and the drawings may be applied according to the present invention either individually or as a plurality of features taken in any combination. In the drawings:

FIG. 1*a* is a schematic sectional view of a valve in a closing position,

FIG. 1*b* is a schematic, enlarged detail view of the closing position,

FIG. 2*a* is a schematic sectional view of a valve in an opening position,

FIG. 2*b* is a schematic, enlarged detail view of the opening position,

DETAILED DESCRIPTION OF THE INVENTION

Figure 3A:
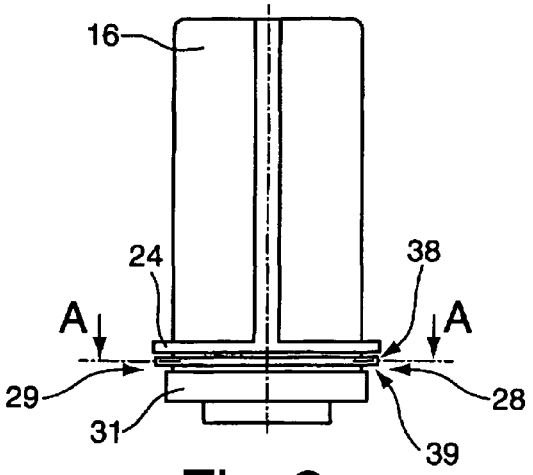
FIG. 3*a* is a schematic side view of a closure member of the valve.

FIG. 1*a* represents a schematic sectional view of a valve 11 according to the present invention. A valve 11 of this type comprises a valve body 12 on which a container lid 14 of a container, not shown in greater detail, may be arranged, or with which it is integrally formed or to which it is rigidly connected. A container of this type is preferably designed to hold pressurised fluids. The container serves in particular for storing and discharging fluids set under pressure by means of compressed air or by means of a propellant. Fluids preferably used include self-curing polyurethane foams, highly active polyurethane foams and adhesives.

The valve body 12 accommodates a closure member 16 within a passage 17. A holding means 18, preferably a spring-like clamp, is applied to the valve body 12, so as to position the closure member 16 in a closing position 21 with respect to the valve seat 22 on the valve body 12 when it is in a normal, non-actuated position. The closure member 16 is provided with a sealing in the form of a sealing lip 24. Alternatively, a plurality of sealing lips 24, or sealing portions of another type, may be provided to be in contact with the valve seat 22 when they are in a closing position 21, thus sealing the passage 17 in a fluid-tight manner.

In addition, the valve body 12 has a cylindrical tube portion 26 in which the closure member 16 is guided so as to be longitudinally displaceable therein. On an outer side of the tubular cylinder portion 26, circumferential, disc-shaped portions 27 are provided so as to seal the connection zone when a spraying device, not shown in greater detail, is connected.

The closure member 16 is provided with a wear protection device 28 which faces in the outflow direction of the fluid and is preferably realised in the form of at least one retaining lip 29. This retaining lip 29 is arranged between the sealing lip 24 and a punch portion 31 of the closure member 16.

When it is in a closing position 21, the sealing lip 24 is deformed, or slightly bent, over the holding means 18 due to the closing force so that it is turned towards the retaining lip 29 and abuts completely on the valve seat 22.

FIG. 1*b* represents an enlarged view of this closing position 21 of the closure member 16 with respect to the valve body 12. Depending on a distance between the sealing lip 24 and the retaining lip 29, the width of the disc-shaped portion of the sealing lip 24 and/or the thickness and thus the strength of the sealing lip 24, both the degree of deformation or bending of the sealing lip 24 and a bending of the retaining lip 29 resulting therefrom are determined.

Preferably disc-shaped, the retaining lip 29 has anchoring elements 33 that are formed between recesses 32 and the configuration of which is explained in greater detail in the following with reference being made to FIGS. 3*a* and 3*b* as well as to FIGS. 4 and 5.

The wear protection device 28 may also be configured, as an alternative to the configuration of a retaining lip 29, by for example pin-shaped elements which extend radially outward. These pin-shaped elements may equally be flexible or deformable, such that they may assume a disposition or a bending analogous to that of the anchoring elements of the retaining lip.

Furthermore, sleeve-shaped elements may alternatively be designed to be formed instead of the pin-shaped elements, such that part of the fluid which is cured may become anchored in the interior of the sleeve.

Further, a wear protection device 28 may alternatively be designed to be formed instead of a disc-shaped retaining lip and provided with a circumferential ring portion that is shaped in an undulated or zigzagging manner. This ring portion may be formed with or without recesses 32. Thus it may be achieved, in turn, that the sealing lip 24 is moved towards the wear protection device 28 shaped in the form of a circumferential ring, so as to form undercut portions for safely accommodating the at least one remainder of cured fluid 37.

FIG. 2*a* represents an opening position 35 of the closure member 16 with respect to the valve body 12. FIG. 2*b* shows a schematically enlarged view of the opening position 35. Owing to the material properties of the closure member 16, which is preferably made of plastic, the sealing lip 24 rests in the inclined or bent contour with respect to the punch portion 31 that it is forced to assume by the closing force of the holding means 18 of the sealing lip 24. During an opening position 35, the sealing lip 24 is only slightly straightened. In the case of a flexible configuration of the sealing lip 24, the latter may assume a position extending radially outward, lying in a plane normal to the longitudinal axis of the closure member 16.

Figure 3B:
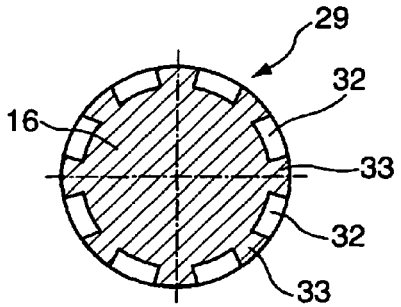
FIG. 3*b* is a schematic sectional view of the closure member taken along the line A-A in FIG. 3*a*.

FIG. 3*a* represents a schematic side view of the closure member 16 with a retaining lip 29 acting as a wear protection device 28. FIG. 3*b* shows a sectional view taken along the line A-A of FIG. 3*a*. This sectional view represents in particular the arrangement of the anchoring elements 33 that are formed by the recesses 32 arranged adjacent thereto. In the embodiment represented in FIG. 3*b*, the recesses are realised in a square or a rectangular shape. Thus, seen in a radial view, each anchoring element 33 forms undercuts. An anchoring by positive engagement or a catching with fluid curing in the region between the sealing lip 24 and the punch portion 31 may thus take place, which leads to the formation of a kind of an annular or at least partially annular remainder of cured fluid.

Figure 4:
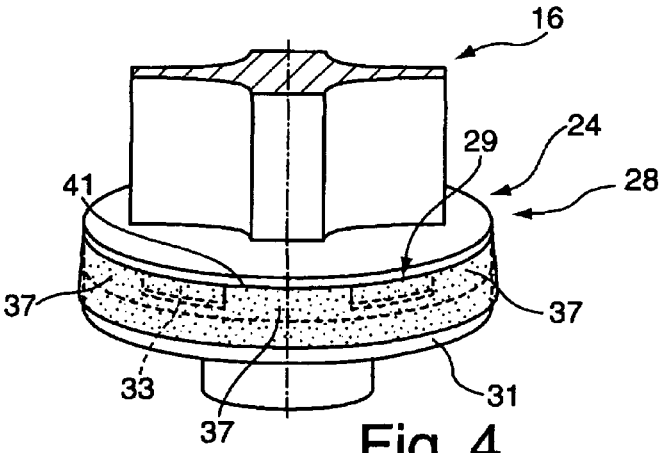
FIG. 4 is a perspective partial view of the closure member with cured fluid formed thereon.

FIG. 4 shows such a cured portion 37 of the fluid. FIG. 5 shows a sectional representation of the perspective view in FIG. 4, with the section line in FIG. 4 lying within a recess 32.

Owing to the deformation of the sealing lip 24, an undercut is formed in a gap 38 between the sealing lip 24 and the retaining lip 29, in which undercut the cured fluid 37 formed therein is positively entrapped so as to be prevented from becoming detached spontaneously. An analogous assembly may be provided in a gap 39 between the retaining lip 29 and the punch portion 31 if the sealing lip 24 acts upon the retaining lip 29, such that the latter is at least partially inclined in the direction of the punch portion 31.

In an alternative embodiment which is not shown, the retaining lip 29 may be designed to extend radially outward in a straight line. The mere gap 39 that has formed is sufficient to make it possible that a remainder of cured fluid 37, which usually extends in an annular manner in the gap 39, is automatically held close to the wear protection device 28 or to the retaining lip 29. If the retaining lip 29 with its anchoring elements 33 extends radially outward in a straight line, the cured fluid 37 may be additionally secured in the gap 39 by the fact that the recesses 32 allow the formation of land-shaped remainders of cured fluid which extend from the gap 38 to the gap 39 or vice versa. Thus, the remainder of cured fluid 37 in the gap 39 is secured with respect to the cured fluid in the gap 38 via the land-shaped portions of cured fluid.

Figure 5:
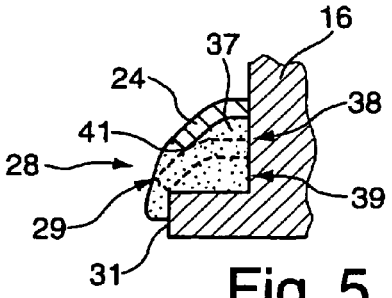
FIG. 5 is a schematic local section of the closure member according to FIG. 4.

The assembly shown in FIG. 5 in an enlarged view is made possible, for example, by the fact that the disc-shaped portion of the sealing lip 24 is realised so as to be larger than that of the retaining lip 29, such that a leading edge 41 of the sealing lip facing towards the retaining lip 29 acts upon a free end of the anchoring elements 33 of the retaining lip 29 so as to deform them slightly and to incline them in the direction of the punch portion 31, such that the gap 39 comprises again an undercut.

By the assembly of the at least one sealing lip 24 and the at least one retaining lip 29 with respect to the punch portion 31, it may be achieved, in addition, that annular, circumferential stiffenings that form in the peripheral area of the sealing lip 24 or the retaining lip 29 may equally be formed with sufficient strength and stiffness so that during the opening and closing movements of the closure member 16 an at least positive engagement with the at least one retaining lip is accomplished.

By this configuration of the valve 11 according to the present invention, it is thus achieved that in spite of remainders of cured fluid 37 which have at least partially been formed on the closure member 16, a repeated opening and closing of the valve 11 is possible and a safe sealing of the valve seat 22 by the at least one sealing lip 24 is ensured.

The invention claimed is:

1. A valve for a container for dispensing pressurized fluid, having a valve body which is mountable on a container lid, a closure member which is arranged in a passage provided in the valve body, a sealing arranged on the closure member and formed of at least one disc-shaped sealing lip and which, when the closure member is in a closing position relative to the valve body, abuts on a valve seat of the valve body provided on the passage thereof, and holding means by means of which the closure member is displaceably arranged in the valve body and held in a closing position therein when the closure member is in a normal position, wherein upstream with respect to an outflow direction of the fluid, at least one wear protection device is associated with the at least one sealing lip, which the at least one wear protection device is provided as at least one retaining lip.

2. The valve of claim 1, wherein the retaining lip is provided with anchoring elements which are formed between recesses in the retaining lip.

3. The valve of claim 2, wherein the retaining lip is disc-shaped.

4. The valve according to claim 1, wherein the retaining lip is arranged at a distance from the at least one sealing lip so as to form a gap.

5. The valve of claim 2, wherein the recesses are formed in the disc-shaped retaining lip so as to be evenly distributed about the circumference.

6. The valve of claim 2, wherein the recesses of the at least one retaining lip have a geometry differing from each other.

7. The valve of claim 2, wherein the recesses have a U-shaped or a rectangular configuration.

8. The valve of claim 1, wherein the retaining lip has an outer periphery which is equal to, or smaller than, the outer periphery of the at least one sealing lip.

9. The valve of claim 1, wherein a punch portion of the closure member, which is arranged adjacent to the retaining lip and opposite the sealing lip with respect to the retaining lip, has an outer periphery which is equal to, or smaller than, the outer periphery of the retaining lip.

10. The valve of claim 1, wherein the thickness of the disc-shaped retaining lip is equal to, or smaller than, the thickness of the sealing lip.

11. The valve of claim 1, wherein at least the gap between the sealing lip and the retaining lip or the width or the thickness of the sealing lip as compared to the retaining lip are provided such that the sealing lip is deformable in the valve seat by the valve seat when in a closing position and an outer, leading edge facing the retaining lip abuts on said retaining lip or abuts on the retaining lip with at least a low force.

12. The valve of claim 1, wherein at least the gap between the retaining lip and the punch portion or the width or the thickness of the retaining lip with respect to the punch portion are provided such that the retaining lip is deformable by the sealing lip so as to be inclined in the direction of the punch portion and abuts on an annular surface of the punch portion or is arranged at a small distance therefrom.

13. The valve of claim 1, wherein the retaining lip is arranged separate from the valve seat when the closure member is in a closing position.

14. The valve of the claim 1, wherein the at least one retaining lip is formed integrally with the valve body.

15. The valve of claim 1, wherein the at least one retaining lip is formed as a slip-on ring on the closure member.

* * * * *